US012798853B2

(12) United States Patent
Rothenbuehler et al.

(10) Patent No.: US 12,798,853 B2
(45) Date of Patent: Nov. 17, 2026

(54) FLEXIBLE PACKAGING FOR A LIQUID AND METHOD OF MANUFACTURING SUCH A PACKAGING

(71) Applicant: SOCIETE DES PRODUITS NESTLE S.A., Vevey (CH)

(72) Inventors: Martin Rothenbuehler, Langnau (CH); Xavier Gourlaouen, Muri Bei Bern (CH)

(73) Assignee: Societe des Produits Nestle S.A., Vevey (CH)

( * ) Notice: Subject to any disclaimer, the term of this patent is extended or adjusted under 35 U.S.C. 154(b) by 173 days.

(21) Appl. No.: 18/721,051

(22) PCT Filed: Dec. 20, 2022

(86) PCT No.: PCT/EP2022/086888
§ 371 (c)(1),
(2) Date: Jun. 17, 2024

(87) PCT Pub. No.: WO2023/118070
PCT Pub. Date: Jun. 29, 2023

(65) Prior Publication Data

US 2025/0066095 A1 Feb. 27, 2025

(30) Foreign Application Priority Data

Dec. 21, 2021 (EP) ..... 21216424

(51) Int. Cl.
*B65D 75/58* (2006.01)
*B65B 9/02* (2006.01)
(Continued)

(52) U.S. Cl.
CPC ..... *B65D 75/5811* (2013.01); *B65B 9/023* (2013.01); *B65B 25/001* (2013.01);
(Continued)

(58) Field of Classification Search
CPC .... B65D 75/5811; B65D 75/30; B65D 75/42; B65D 75/5866; B65D 2575/586;
(Continued)

(56) References Cited

U.S. PATENT DOCUMENTS 4,113,169 A 9/1978 Carlisle
4,974,732 A 12/1990 Sullivan et al.
(Continued)

FOREIGN PATENT DOCUMENTS

CN 106458415 A 2/2017
CN 112119023 A 12/2020
(Continued)

OTHER PUBLICATIONS

International Search Report for International Application No. PCT/EP2022/086888 mailed Mar. 17, 2023, 6 pages.
(Continued)

*Primary Examiner* — David J Walczak
(74) *Attorney, Agent, or Firm* — K&L Gates LLP

(57) ABSTRACT

A packaging for a liquid includes two layers of flexible material which are arranged superimposed each other and sealed together to form a pouch. The two layers are furthermore sealed together in a sealing region extending at a distance from an edge of the packaging while leaving a transition region free from sealing. The sealing region comprises a splitter extending along a part of the sealing region, the splitter being shaped and arranged so that it is configured to provide a spout comprising the outlet channel. The spout is obtained by applying a separation extending from the edge to the splitter and then along the splitter, and wherein the sealing region has a shape comprising at least one bulge protruding in a plane of the sealing region.

16 Claims, 8 Drawing Sheets

(51) Int. Cl.

| | |
|---|---|
| ***B65B 25/00*** | (2006.01) |
| ***B65B 51/26*** | (2006.01) |
| ***B65D 75/30*** | (2006.01) |
| ***B65D 75/42*** | (2006.01) |

(52) U.S. Cl.
CPC ..... *B65B 51/26* (2013.01); *B65D 75/30* (2013.01); *B65D 75/42* (2013.01)

(58) Field of Classification Search
CPC ... B65D 75/5805; B65B 9/023; B65B 25/001; B65B 51/26
USPC .. 222/107, 541.1, 541.2, 541.4, 41.5, 541.6, 222/207
See application file for complete search history.

(56) References Cited

U.S. PATENT DOCUMENTS

| | | | | |
|---|---|---|---|---|
| 5,005,734 | A | 4/1991 | Van Gordon et al. | |
| 5,228,782 | A | 7/1993 | Imer | |
| 5,558,438 | A * | 9/1996 | Warr | B65D 75/5816 383/17 |
| 5,746,352 | A | 5/1998 | Corella | |
| 11,505,383 | B2 * | 11/2022 | Steele | B65D 33/18 |
| 2002/0136470 | A1 | 9/2002 | Richardson | |
| 2011/0064338 | A1 | 3/2011 | Surdziel | |
| 2011/0075954 | A1 | 3/2011 | Kumar et al. | |
| 2012/0168025 | A1 | 7/2012 | Cerveny et al. | |
| 2020/0262632 | A1 | 8/2020 | Ellis et al. | |

FOREIGN PATENT DOCUMENTS

| | | |
|---|---|---|
| GB | 2539479 | 12/2016 |
| JP | 2013224167 | 10/2013 |
| KR | 200319892 Y1 | 7/2003 |
| WO | 8000332 | 3/1980 |
| WO | 2010147212 | 12/2010 |

OTHER PUBLICATIONS

Written Opinion of the International Searching Authority for International Application No. PCT/EP2022/086888 mailed Mar. 17, 2023, 9 pages.
Chinese Office Action from corresponding Chinese Patent Application No. 202280083096.5, mailed May 14, 2026. 13 pages.

* cited by examiner

FLEXIBLE PACKAGING FOR A LIQUID AND METHOD OF MANUFACTURING SUCH A PACKAGING

CROSS REFERENCE TO RELATED APPLICATIONS

The present application is a National Stage of International Application No. PCT/EP2022/086888, filed on Dec. 20, 2022, which claims priority to European Patent Application No. 21216424.8, filed on Dec. 21, 2021, the entire contents of which are being incorporated herein by reference.

FIELD OF THE INVENTION

The present invention relates to a flexible packaging for a liquid, which liquid may e.g. be a beverage. In particular, it relates to such a packaging comprising a built-in spout to be used for drinking or pouring.

In some embodiments of the invention, the spout has a self-closing design so that the spout has a normally closed configuration keeping it closed when no force is applied to the packaging after it has been opened. The invention further relates to a method of manufacturing such a packaging.

BACKGROUND OF THE INVENTION

Packagings for a liquid which is to be dispensed by use of a spout are known from many applications. Such a spout may e.g. be a drinking spout for the consumption of a beverage, or it may be a spout used for the pouring of the liquid out of the packaging and possibly into another container.

In relation to packaging holding a beverage, many prior art solutions comprise a separate drinking straw packed into a separate thin cover fastened to the package by gluing. This means that three different pieces made from different materials are to be manufactured and joined. Furthermore, the thin cover is litter which is often dropped on the ground if there is no bin nearby. If the packaging is not provided with a closable lid, it can be difficult to store it without spilling e.g. during transportation. Other solutions have a built-in rigid plastic spout sealed at the edge of a pouch or have an otherwise built-in spout provided by a design comprising additional sealing area.

When the liquid is to be poured out of the packaging, this may need a separate spout, or it is poured from an edge of the packaging possibly resulting in a risk of spilling, especially when the package is made from a flexible material.

Hence, an improved flexible packaging for a liquid would be advantageous.

OBJECT OF THE INVENTION

It is an object of the present invention to provide a packaging for liquid which can be made from sheet of layered material in which a spout is built into the packaging so that there is no need for a separate element therefore.

It is another object of the present invention to provide a packaging for liquid for which less components are needed than with prior art packaging.

It is another object of the present invention to provide a packaging for liquid which can be manufactured in a more efficient manner than prior art packaging.

It is another object of the present invention to provide a packaging for liquid which can be manufactured in another manner than prior art packaging.

It is an object of at least some embodiments of the present invention to provide a packaging for liquid which has a self-closing outlet from the receptacle in which the liquid is stored.

It is a further object of the present invention to provide an alternative to the prior art.

In particular, it may be seen as an object of the present invention to provide a flexible packaging for liquid that solves the above mentioned problems of the prior art.

SUMMARY OF THE INVENTION

The above described object and several other objects are intended to be obtained in a first aspect of the invention by providing a packaging for a liquid, the packaging comprising an area of two layers of flexible material which layers are arranged superimposed each other and sealed together to form or close a pouch, wherein the two layers are furthermore sealed together in a sealing region, wherein the sealing region:

extends at a distance from an edge of the packaging, and leaves a transition region free from sealing, the sealing region thereby forming a delimitation between a receptacle for holding the liquid and an outlet channel, which outlet channel is in fluid communication with the receptacle via the transition region, wherein the sealing region comprises a splitter extending along a part of the sealing region, the splitter being shaped and arranged so that it is configured to provide a spout comprising the outlet channel, and wherein the spout is obtained by providing a separation extending from the edge to the splitter and optionally along the splitter, and wherein wherein the sealing region (3) has a shape comprising at least one bulge (15) protruding in a plane of the sealing region (3).

The liquid may in principle be any liquid which will be relevant to dispense via a spout from a receptacle in which it is has been stored. The invention has been developed in relation to packaging for beverages, such as fruit juice, ice tea, syrup, or drinking yoghurt. For such uses, the spout can be used as a drinking spout. However, the scope of protection also covers packagings and content for which the spout is used for pouring out the liquid, e.g. into a container. This may e.g. be a pouring into a glass or bowl from which a beverage is to be consumed, if this is preferred over drinking directly from the spout. It may also be used for liquids not to be consumed. A non-exhaustive list of examples of is: liquids to drink or to prepare a food recipe, such as water, milk, syrups, vegetable oil, or vinegar; higher viscous products, such as fruit purees or sweet condensed milks; pastes, such as Nutella or other spreads; liquids for medical or pharmaceutical applications; technical liquids, such as car coolant refill products; cleaning agents, such as soaps or liquid for washing clothes; liquid cosmetics or fluids, such as skin cares; paint; glue; ice cream; sealants silicone; agriculture products, such as fertilizer or pesticides; food or drinks to be consumed in space or other non-gravity environment; foods or drinks to be consumed under water.

The packaging according to the invention further has the advantage that it stops free flow of the liquid out of the packaging. The invention even allows that no leaking takes place with light pressure on the packaging.

By "flexible material" is meant a material having elastic properties allowing it to deform during both filling and emptying of the receptacle, preferably without causing any significant plastic deformation. By "significant" is meant to an extent that would impede the intended functioning of the packaging.

By "sealing" is meant that the layers are joined in a manner resulting in a liquid-tight pouch suitable for storage of the liquid over time without causing leakage. It may e.g. be by heat-sealing, welding, or gluing dependent on the type of material used. Such sealing methods and how to perform them will be well known to a person working within the technical field of packaging. Different ways of obtaining a pouch by folding and sealing the layers of material will be shown in the figures.

The fact that the sealing region extends at a distance from an edge of the packaging does not imply that the distance needs to be constant along the sealing region, but it may be. Examples of designs will be shown in the figures from which it will be clear that the distance may be different but may also vary.

By "optionally along the splitter" is meant that in some embodiments, separation is obtained only by applying the separation extending from the edge to the splitter, since the rest of the splitter is in the form of an already provided hole. Such an embodiment will be described below and also shown in the figures.

In some embodiments of the invention, the sealing region extends:

- from a first edge of the packaging along a direction of extension towards an opposite second edge while leaving a transition region free from sealing, and
- at a distance from a third edge of the packaging, the third edge extending between the first and second edges, and
- the splitter extends in the direction of extension of the sealing region, the spout being obtained by providing a separation extending from the third edge to the splitter and then optionally along the splitter.

The edges of the packaging do not need to be straight but could also be curved, or they could be straight but meeting in rounded corners. What is called "edges" could also be referred to as "sides" of the packaging.

In some embodiments of the invention, the splitter is in the form of a first and a second spaced apart holes which are through-going and interconnected by a weakened line provided by partial cuts through the sealing region, the weakened line extending along the sealing region, the first hole being located so that the applying of the separation includes applying the separation extending from the edge to the first hole and then tearing along the weakened line into the second hole. By letting the weakened line have holes at the ends, the risk of tearing too far and thereby possibly providing an undesired leakage of the liquid is limited. The partial cuts may e.g. be a row of interrupted dashes, dots, or dash-and-dots. The cutting may be through-going or go only partially through the material.

In such embodiments, the first hole may have an elongate shape with a longitudinal extension along the sealing region. Since a side edge of this elongate hole will form a part of the outer surface of the spout, such an embodiment is particularly advantageous when the spout is to form a drinking spout. Hereby it is obtained that the spout has a smooth surface to be put in the mouth during drinking. By having a part of the splitter in the form of a weakened line may keep the appearance of the packaging better before consumption, and it may also provide stiffness to the packaging which facilitates the handling e.g. during storage or transportation of the packaging until use.

In alternative embodiments, the splitter is in the form of an elongate and through-going third hole extending along the sealing region. Hereby the separation is to be done only from the edge to the hole. This means that a tool, such as a pair of scissors can be used to provide the spout without any tearing being necessary.

In other alternative embodiments, the splitter is in the form of a weakened line provided by partial cuts through the sealing region, the weakened line preferably extending along a curved, such as a semi-circular, path at end regions of the weakened line. This means that no material needs to be removed during the manufacturing of the packaging. The purpose of the curved path at the end regions is to prevent unintended tearing into the surrounding material which could result in a point of leakage of the liquid.

In any of the embodiments as described above, the packaging may be provided with a notch extending from the edge in the direction towards the splitter. Such a notch would ensure that the separation takes place at the intended location, and it also facilitates the initiation of the separation in case it is performed manually.

The packaging and the location of the notch is preferably so that the corner-piece next to the notch remains connected to the packaging whereby it is avoided that a small piece of litter is provided by the opening of the packaging.

The overall shape of the packaging may be rectangular, possibly with rounded corners. However, other shapes will also be covered by the scope of protection, such as packagings with a more triangular or circular appearance. By "overall shape" is meant the shape when the packaging is empty whereas when it contains the liquid, the exact appearance depends on the degree of filling of the receptacle.

In some embodiments, the packaging is provided with a third side made from an additional layer of material as will be shown in the figures. Such a third side may e.g. be a bottom side allowing the packaging to stand upright without being supported.

In some embodiments of the invention, the packaging comprises a sealing next to the outlet channel, said sealing comprising a slit shaped and dimensioned to receive a free end of the spout. By "receive" is meant that the free end is inserted into the slit after bending the spout accordingly to reach the slit. During the development of the present invention, it was realized that by arranging the free end of the spout in such a slit, a high degree of self-closing of the spout could be ensured. At least for some embodiments, it has been found very difficult to manually force any liquid out of a spout arranged in such a slit.

Preferably, the dimensions of the transition region and the outlet channel as well as any sealing adjacent thereto is predetermined in order to provide a stiffness of the flexible material forming the transition region and the outlet channel resulting in a self-closing effect of the outlet channel, so that, after the spout has been obtained by applying the separation, there is no flow of liquid out of the receptacle, when no pressure is applied to the packaging. Work performed during the development of the invention has shown that it is possible to obtain a self-closing effect strong enough to allow for holding an opened packaging upside-down without any immediate liquid flow out of the spout.

According to the invention, the sealing region may have a shape comprising at least one bulge protruding in a plane of the sealing region. The bulges may protrude from the sealing region, from sealing along an edge, or both. Such at least one bulge has been found to be an efficient way of obtaining a desired stiffness as will be explained in further details in relation to the figures.

In a preferred embodiment of the packaging according to the invention there are two or more bulges distributed along the outlet channel, said two or more bulges are more preferably protruding from opposite sides of the sealing region, even more preferably without facing one another. This allows a narrow channel to be created which again provides a self closing effect.

Additional stiffness may be provided to the packaging by one or more of the following: embossment on one or both layers, heating of the layers, application of one or more stiffening bands, or using material with different stiffnesses for the two layers. By "heating of the layers" is preferably being referred to embodiments in which the sealing is obtained by heat-sealing. For some materials, this applied heating will cause deformations, such as wrinkles, out of the plane of the layer, and such deformations may provide stiffness to the packaging. If desired, heating could also be applied as an additional step even when other methods are used for the sealing.

The layers of flexible material may be made from any material which is suitable for the purpose both with respect to the manufacturing of the packaging and to storage of the specific liquid. It may be the same material throughout, or it may be a laminate of different materials each providing different features to the packaging, such as stiffness, liquid-tightness, wear protection, and protection against oxidation. Different properties may be provided by different types of materials, such as paper-based, polymer-based and metal-based materials. It may also be relevant to use a coated material, such as a coating allowing for heat-sealing or gluing of a packaging mainly made from a material not on its own suitable for such a method of sealing.

As an example, a flexible laminate which has been found suitable for a packaging according to the present invention may be built in the following way:

A: Printing carrier in which the polymer base is selected from one or more of the following types: PET, PA, PP, and PE. The thicknesses could typically be in the range of 4-50 microns, preferably in the range of 15-30 microns.

B: Middle layer in which the polymer base is selected from one or more of the following types: PET, PA, PP, and PE. The layer may be vacuum deposited with aluminium, SiOX (silicium oxide) or AlOX (aluminium oxide). The thickness would typically be in the range of 4-50 microns, such as in the range of 5-30 microns, preferably in the range of 10-25 microns.

C: A sealant film typically made of PP or PE with less polymer orientation than layer A or B. The thickness is typically in the range of 5-150 microns. Larger pouches typically need higher thicknesses to ensure that they remain closed after sealing.

The functionality of the packaging and the design thereof, including the choice of materials, is driven by two main factors: the stiffness of the flexible materials and the sealing geometry. The above is an example found suitable for some of the products mentioned above. However, for other products, other material combinations may be more suitable.

The volume of the receptacle may be between 40 and 5000 ml, such as between 50 and 1000 ml, or between 1000 and 5000 ml. However, any volume is covered by the scope of protection.

In a second aspect, the invention relates to a method of manufacturing a packaging for a liquid, the method comprising the following steps:

arranging two layers of flexible material superimposed each other, applying heat sealing and cutting resulting in a packaging as in any of the embodiments mentioned above while omitting a part of the sealing to provide a filling region, filling the receptacle with liquid via the filling region, and sealing the filling region.

Alternatively, in a second aspect, the invention relates to a method comprising the following steps:

providing two layers of flexible material in the form of sheet material which is larger than one packaging, applying heat sealing resulting in a plurality of partially closed packagings as in any of the embodiments mentioned above, the packagings comprising the receptacles, and the heat sealing providing a filling region by omitting a part of the sealing, filling the receptacle with liquid via the filling region, sealing the filling region, applying cutting to form the splitter, and cutting along outer circumferences of the plurality of packagings to separate them from each other.

The steps of the methods mentioned above are those to be included. However, they may be performed in another order than the one in which they are listed. Some of the steps may also be performed at the same time. As an example, the cutting between two packagings could be made earlier than filling. This would typically be the case on so-called horizontal form fill sealing lines.

When the layers of flexible material are provided in the form of sheet material which is larger than one packaging, it is typically feed to the manufacturing machine from a roll of material.

In any of the manufacturing methods, the step of filling may be performed under aseptic conditions. By "aseptic" is preferably meant that it is free from contamination caused by harmful bacteria, viruses, or other microorganisms. In other words, aseptic processing can be defined as the processing and packaging of a commercially sterile product into sterilised containers followed by hermetic sealing with a sterilised closure in a manner that prevents viable microbiological recontamination of the sterile product.

The liquid being filled in the packaging may be selected from: fruit juice, ice tea, syrup, drinking yoghurt. However, as mentioned above, the scope of protection also cover methods of manufacturing packagings with content for which the spout is used for pouring out the liquid e.g. into a container. Several other examples were mentioned above.

The first and second aspects of the present invention may each be combined. These and other aspects of the invention will be apparent from and elucidated with reference to the embodiments described hereinafter.

BRIEF DESCRIPTION OF THE FIGURES

The flexible packaging according to the invention as well as a method for manufacturing such a packaging will now be described in more detail with regard to the accompanying figures. The figures show one way of implementing the present invention and is not to be construed as being limiting to other possible embodiments falling within the scope of the attached claim set.

DETAILED DESCRIPTION OF AN EMBODIMENT

Figure 1:
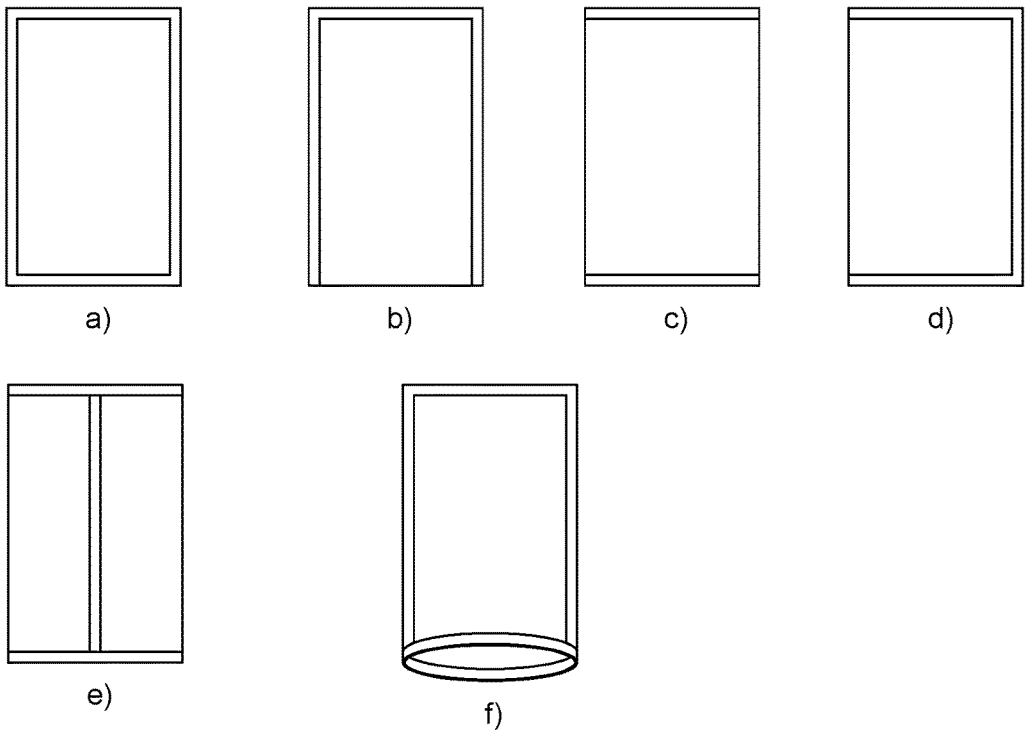
FIG. 1 PRIOR ART
FIGS. 1.*a*-1.*f* schematically show different overall designs of prior art packagings made from layers of flexible material.

FIGS. 1.*a*-1.*f* schematically show different overall designs of prior art packagings made from layers of flexible material. Any of these types of packaging may be used with any combinations of sealing regions and splitters shown in the following figures. In the figures, the packagings are shown as having rectangular shapes. However, as mentioned above, the scope of protection covers any shape which allows for the implementation of the invention. It may e.g. be a triangular, a circular or a partly curved shape. The packagings comprise two layers of flexible material which are arranged superimposed each other and sealed together to form a pouch. As shown in the figures, the sealing may be located along four, three or two sides of the packaging. It may also be along one of the layers, such as midway between two sides of the packaging as shown in FIG. 1.*e*. FIG. 1.*f* shows an example of a packing comprising three layers of which one of them form a bottom side which allows the packaging to stand without being held or otherwise supported. Such a bottom side may also be referred to as a gusseted area.

Figure 2:
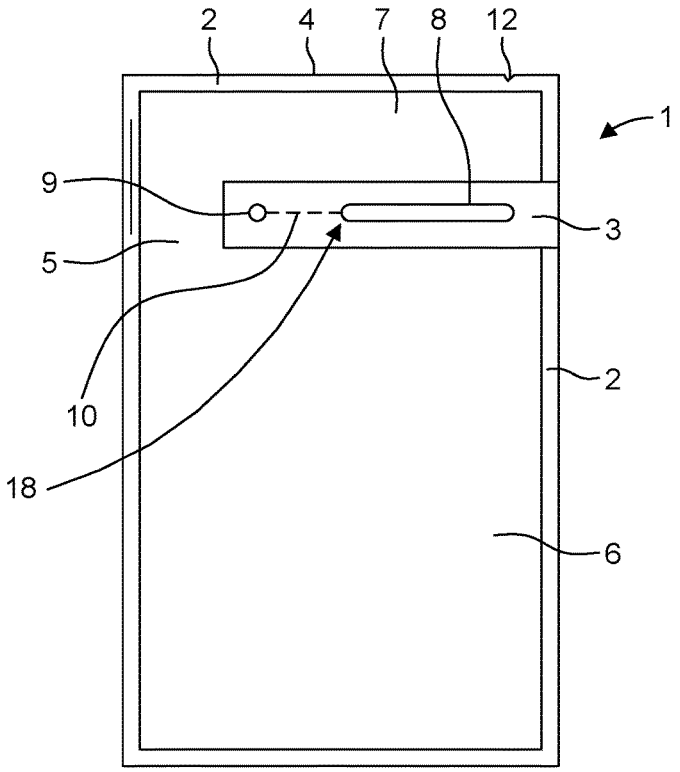
FIG. 2 schematically shows an embodiment of a packaging according to the invention in which the splitter is in the form of two holes interconnected by a weakened line.
Figure 3:
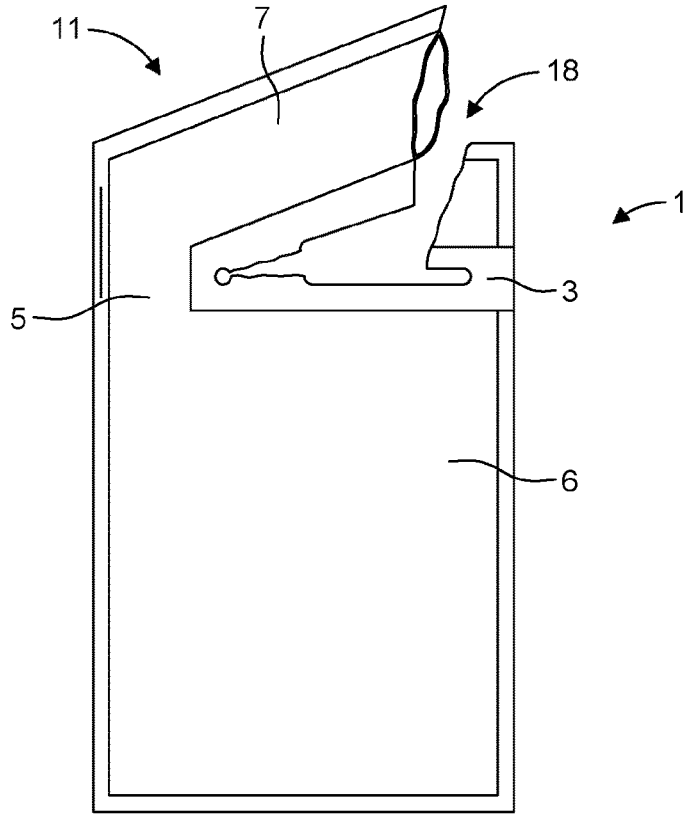
FIG. 3 schematically shows the packaging in FIG. 2 after opening.

FIG. 2 schematically shows an embodiment of a packaging 1 according to the invention. In addition to the sealing 2 forming the pouch itself, the two layers are furthermore sealed together in a sealing region 3 extending at a distance from an edge 4 of the packaging 1 while leaving a transition region 5 free from sealing. Hereby the sealing region 3 forms a delimitation between a receptacle 6 for holding the liquid and an outlet channel 7 which is in fluid communication with the receptacle 6 via the transition region 5. The sealing region 3 comprises a splitter 18 extending along a part of the sealing region 3 which in the embodiment in FIG. 2 is in the form of a first and a second spaced apart holes 8, 9 which are through-going and interconnected by a weakened line 10 extending along the sealing region 3. The weakened line 10 is provided by partial cuts through the sealing region 3, typically in the form of dashes and/or dots. For all the embodiments shown in this and the following figures, the splitter 18 is shaped and arranged so that it is configured to provide a spout 11 comprising the outlet channel 7, the spout 11 being obtained by applying a separation extending from the edge 4 to the splitter 18 and then along the splitter 18; see FIG. 3. In the embodiment in FIG. 2, the first hole 8 is located so that the applying of the separation includes applying the separation extending from the edge 4 to the first hole 8 and then tearing along the weakened line 10 ending in the second hole 9. The packaging 1 is preferably provided with a notch 12 extending from the edge 4 towards the splitter 18 so that it can be ensured that the separation is applied at the desired location. Such a notch 12 will also facilitate the initiation of the separation when it is being done manually. This results in an opened packaging 1 as schematically shown in FIG. 3. By letting the weakened line 10 have first and second holes 8, 9 at the ends, the risk of tearing too far and thereby possibly providing an undesired leakage of the liquid is limited.

Figure 4:
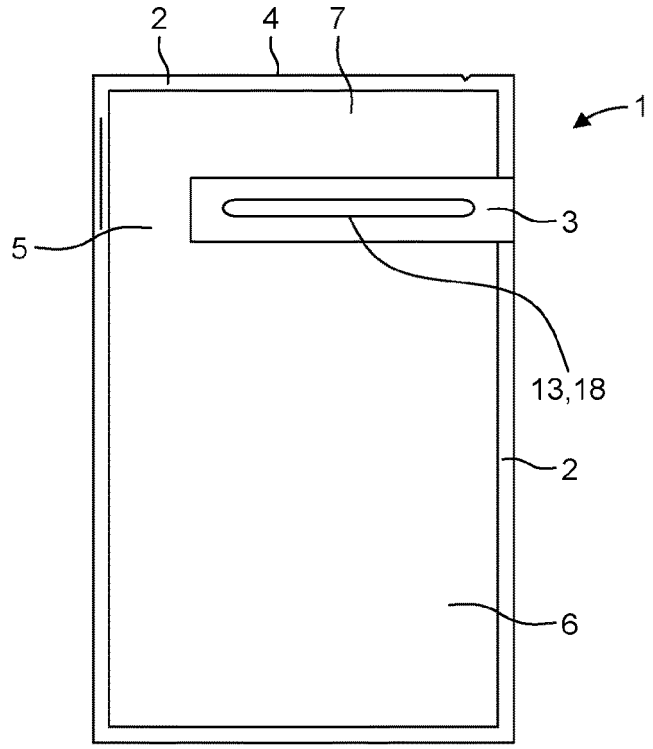
FIG. 4 schematically shows another embodiment of a packaging according to the invention in which the splitter is in the form of an elongate and through-going hole without an interconnected weakened line.

FIG. 4 schematically shows another embodiment of a packaging 1 according to the invention in which the splitter 18 is in the form of an elongate and through-going third hole 13 with a longitudinal extension along the sealing region 3. In this embodiment, the splitter 18 does not include an interconnected weakened line. The first hole 8 of the embodiment in FIGS. 2 and 3 and the third hole 13 in the embodiment in FIG. 4 have an elongate shape with a longitudinal extension along the sealing region 3. Since a side of such an elongate hole will form a part of the outer surface of the spout 11, such embodiments are particularly advantageous when the spout 11 is to form a drinking spout. Hereby it is obtained that the spout has a smooth surface to be put in the mouth during drinking. The second hole 9 might also be elongate, if desired.

Figure 5:
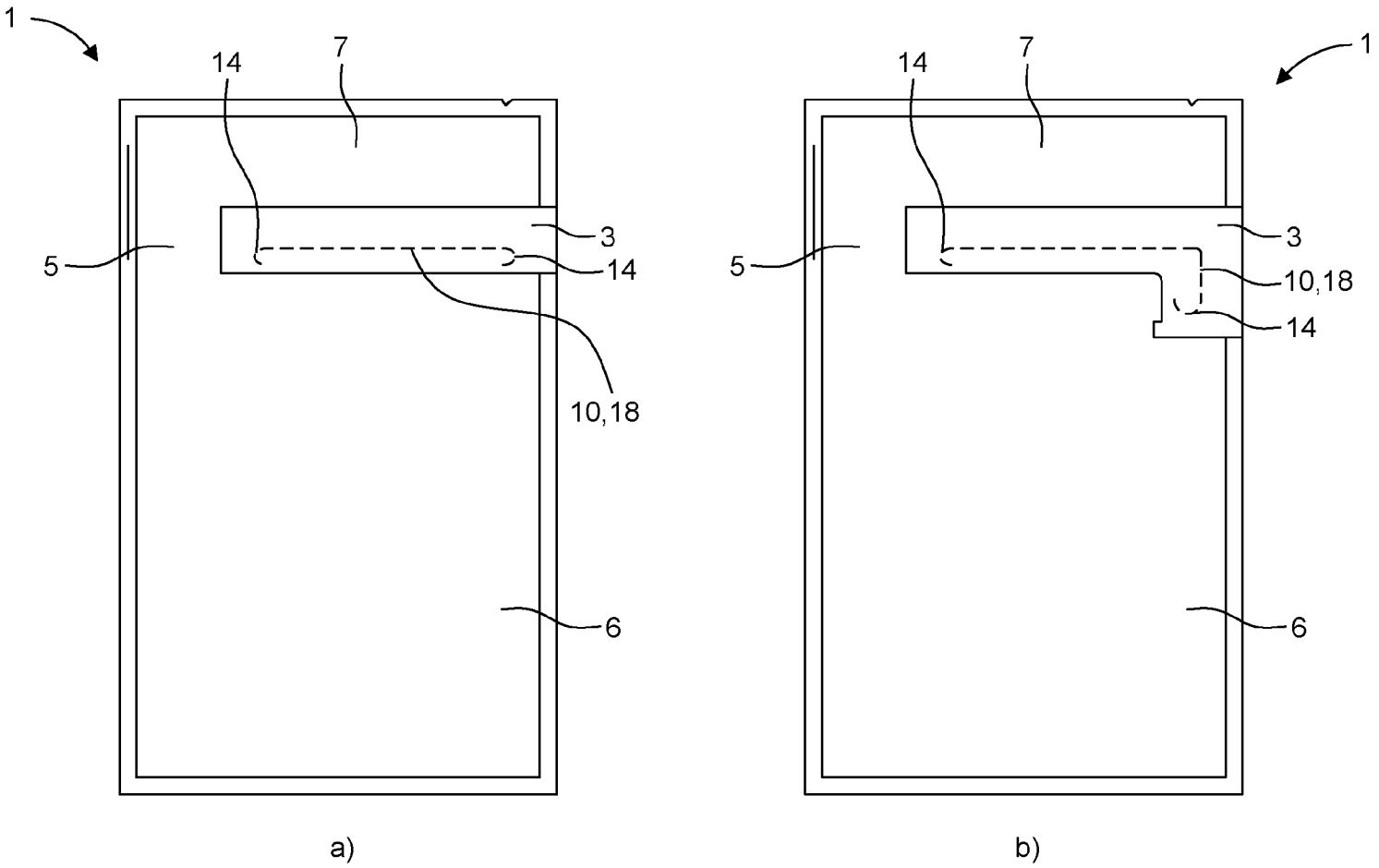
FIGS. 5.*a* and 5.*b* schematically show two other embodiments of a packaging according to the invention in which the splitter is in the form of a weakened line.

FIGS. 5.*a* and 5.*b* schematically show two other embodiments of a packaging 1 according to the invention in which the splitter 18 is in the form of a weakened line 10 provided by partial cuts through the sealing region 3. The weakened line extends along a semi-circular path at the end regions 14 of the weakened line 10. Hereby it can be prevented that a tearing along the weakened line 10 continues into the surrounding material which might potentially result in leakage of liquid. Tests made during the development of the present invention have shown that by letting the weakened line 10 extend in a direction away from the main direction of extension of the sealing region 3, such as perpendicular thereto as shown in FIG. 5.*b*, it is easier to fold the spout 11 into an orientation of use. Furthermore, it makes it easier to move the corner-piece out of the way, when the spout is used for drinking.

Figure 6:
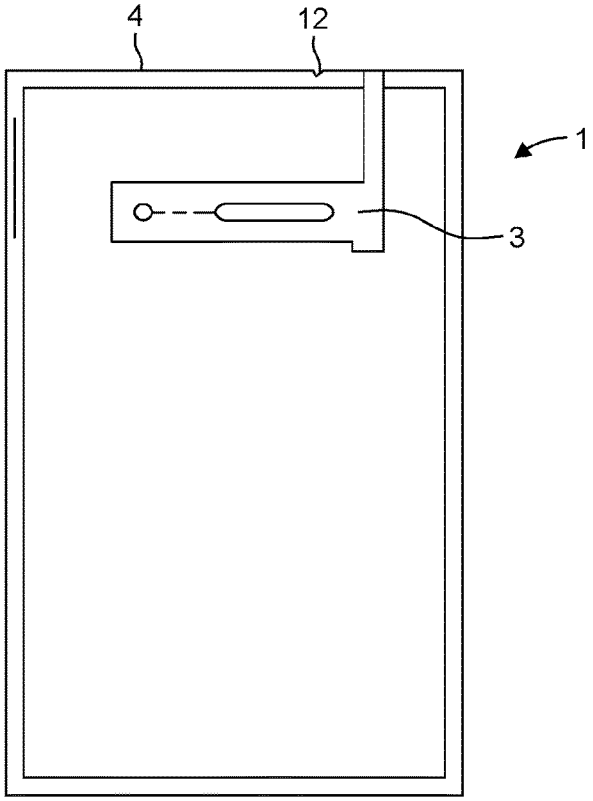
FIG. 6 schematically shows another embodiment of a packaging in which the sealing region comprising the splitter extends from the same edge as where the notch is located.

FIG. 6 schematically shows another embodiment of a packaging 1 in which the sealing region 3 comprising the splitter 18 extends from the same edge 4 as where the notch 12 is located. This is to illustrate that the sealing region 3 may have other shapes than in the above figures.

Figure 7:
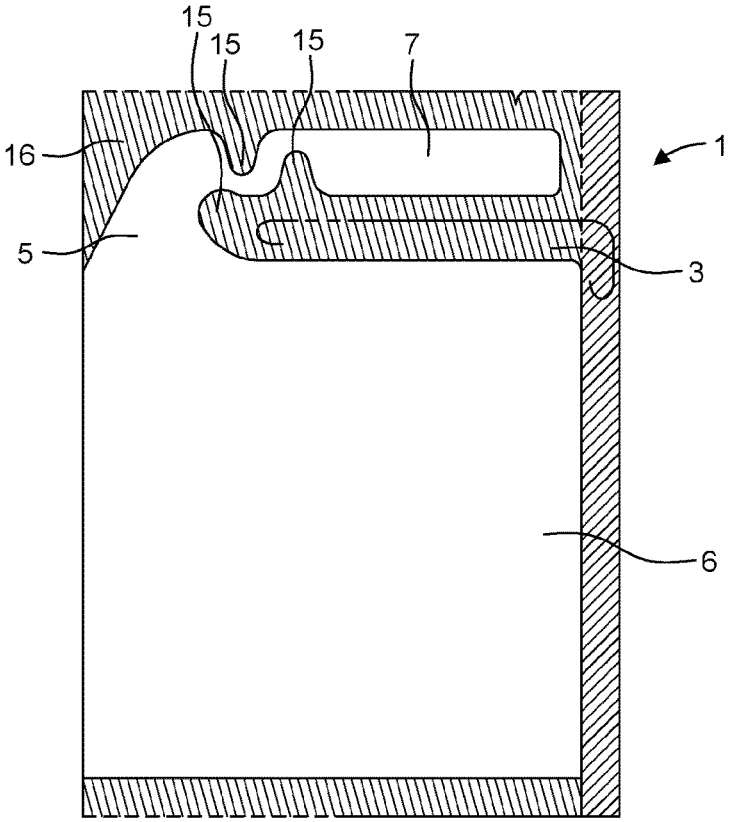
FIG. 7 schematically shows another embodiment of a packaging in which the sealing region is provided with bulges.

In any of the described embodiments, the self-closing effect of the outlet channel 7 can be obtained by predetermining the dimensions of the transition region 5 and the outlet channel 7 as well as any sealing adjacent thereto in order to provide a stiffness of the flexible material forming the transition region 5 and the outlet channel 7 resulting in such a self-closing effect. Hereby it can be ensured that after the spout 11 has been obtained by applying a separation, there is no flow of liquid out of the receptacle 6, when no pressure is applied to the packaging 1. FIG. 7 schematically shows such an embodiment in which the self-closing effect is obtained by using a sealing region 3 having a shape comprising bulges 15 protruding in a plane of the sealing region 3. Furthermore, the shape of the sealing in the corner 16 has been optimised for a given geometry and materials of the layers. In the illustrated embodiment, the sealing region 3 has three bulges arranged in a manner which has been found to give the desired self-closing function. In a preferred embodiment of the invention illustrated here there are two or more bulges 15 distributed along the outlet channel 7, said two or more bulges 15 are protruding from opposite sides of the sealing region 3 without facing one another. However, other numbers and locations of the bulges 15 are also possible. The exact design of a packaging 1 with respect to both the sealing region 3 and the splitter 18 will typically be determined based on all or some of the following parameters: the overall size and shape of the packaging, the type and thickness of the material used for the packaging, the sealing method, and the viscosity of the liquid. It will typically be determined based on experimental testing and/or computer simulations.

Figure 8:
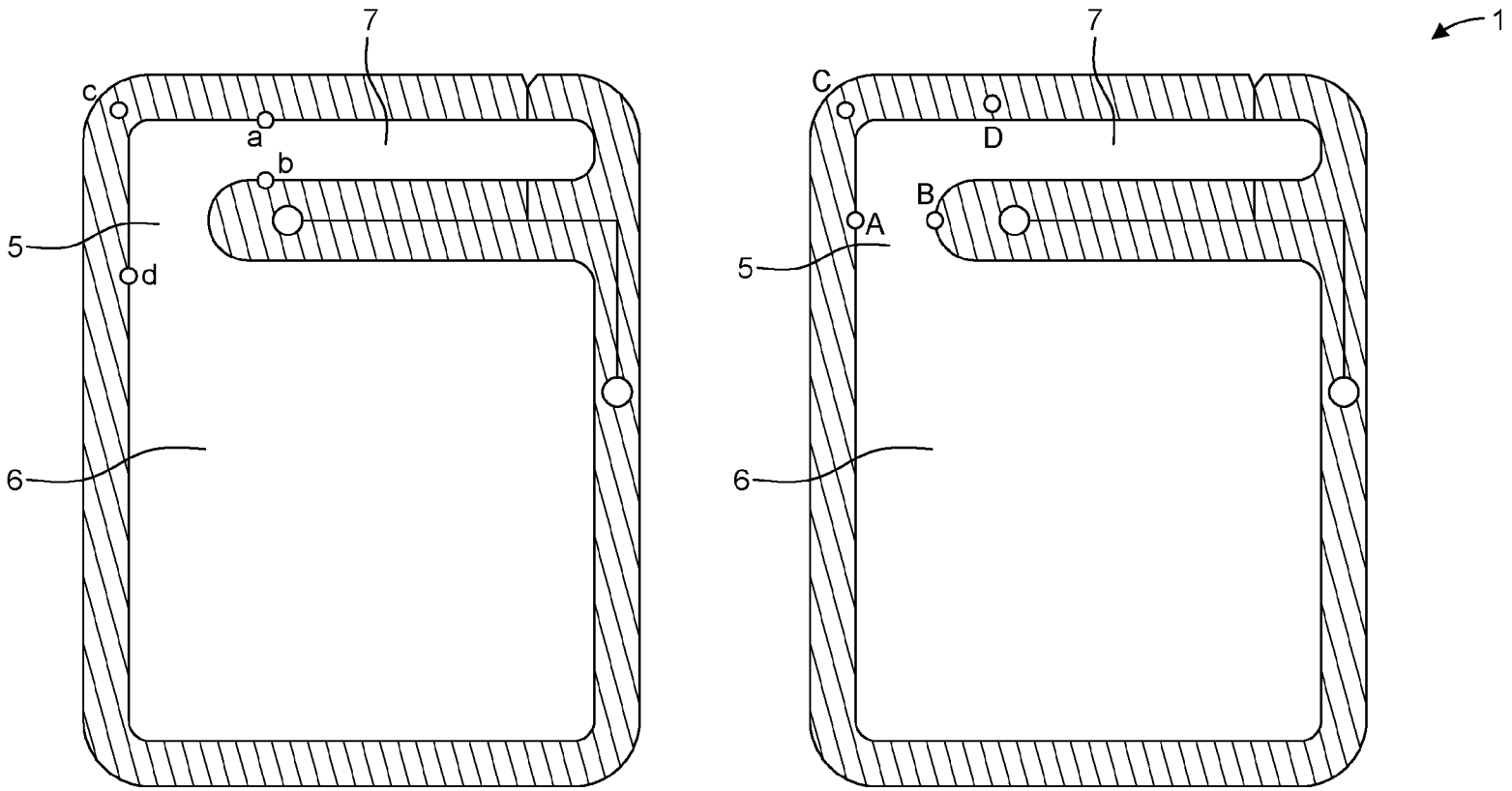
FIG. 8 schematically shows packages according to the invention. The figure is used for the explanation of how the design of a packaging provides stiffening resulting in a self-closing effect when the packaging has been opened.

FIG. 8 schematically illustrates the inventive idea behind a part of the invention relating to the self-closing effect. It can be explained by considering the outlet channel 7 and the transition region 5 as a normally closed valve. By "normally closed" is meant that the valve remains closed, when no external forces are applied thereto. Points c and d are connected by the sealing extending between these points. This provides a stiffening which means that the distance between points c and d remains substantially constant. The same applies to the points C and D. The stiffness of the imaginary line between points c and d will tend to keep the distance between points a and b constant, representing the closed position of the valve, i.e. the outlet channel. Similarly, the imaginary line between points C and D will tend to keep the distance between points A and B constant, representing the closed position of the valve, i.e. the transition region. By designing the packaging 1 as shown in the figures, stiffness in two directions are used to obtain a stronger normally closed valve than if only one flow passage had to be kept closed. By "stronger" is meant with more power to bring all points to their original position, meaning all surfaces flat and thereby the exit from the receptacle 6 closed. The stiffening and resulting self-closing effect may be further manipulated by providing the sealing region 3 with bulges 15 as explained in relation to FIG. 7. In this figure, there are three bulges, but for some embodiments one bulge may be sufficient to provide the necessary stiffening effect.

Figure 9:
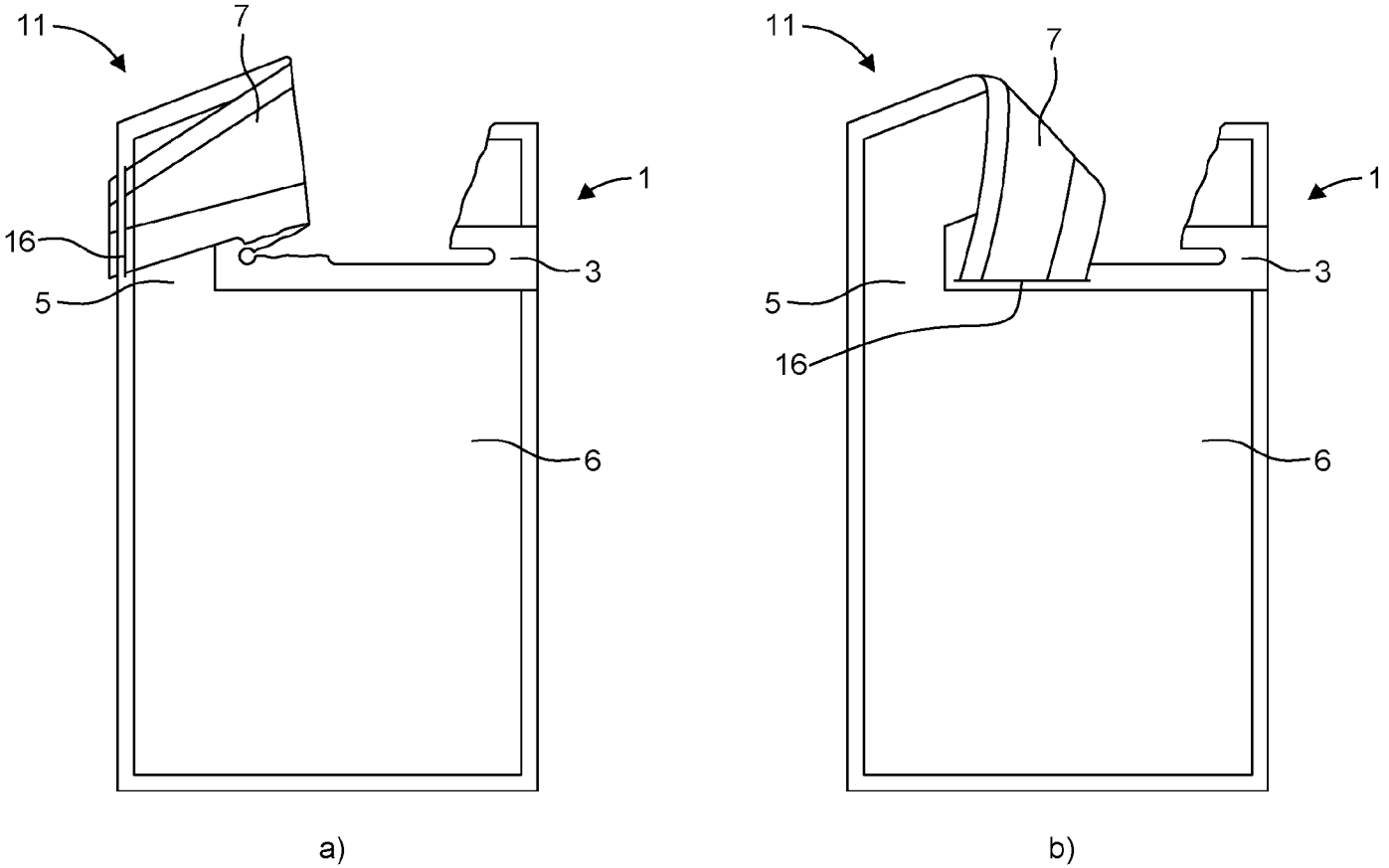
FIGS. 9.*a* and 9.*b* schematically show two embodiments of a packaging provided with a slit for receiving a free end of the spout.

FIGS. 9.*a* and 9.*b* schematically show two embodiments of a packaging 1 comprising a sealing next to the outlet channel 7, said sealing comprising a slit 16 shaped and dimensioned to receive a free end of the spout 11. The figures show two possible locations of such a slit, but other locations may also be chosen provided that it is possible to bend the spout to reach the slit. By arranging the free end of the spout 11 in such a slit as shown in these figures, a high degree of self-closing of the spout 11 is obtained.

Figure 10:
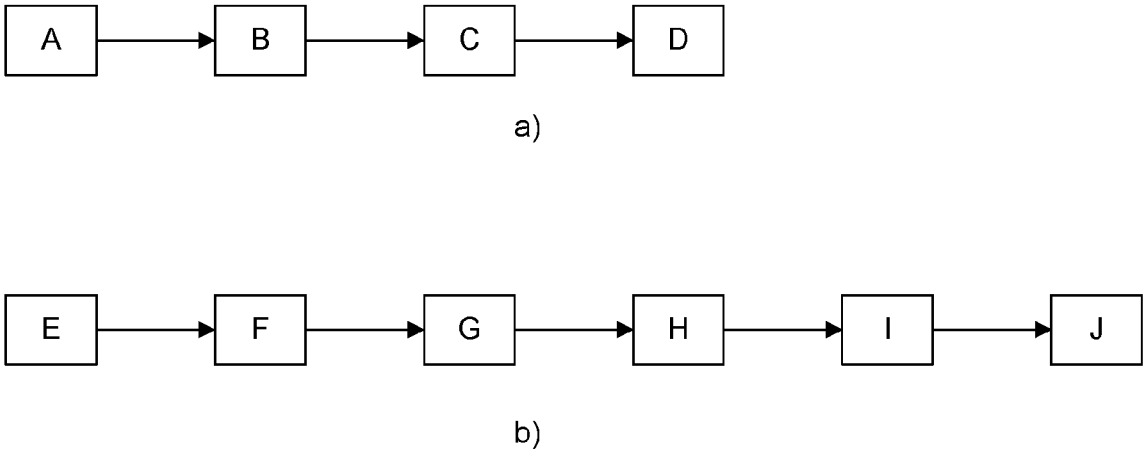
FIGS. 10.*a* and 10.*b* are flow-charts of two different methods of manufacturing a packaging according to the invention.

FIGS. 10.*a* and 10.*b* are flow-charts of two different methods of manufacturing a packaging according to the invention. The method in FIG. 10.*a* comprises the following steps:

A: arranging two layers of flexible material superimposed each other;

B: applying heat sealing and cutting resulting in a packaging according to the invention while omitting a part of the sealing to provide a filling region;

C: filling the receptacle with liquid via the filling region; and

D: sealing the filling region.

In some embodiments of the invention, steps A and B may be performed on another machine than the one used for steps C and D. In that case, the pouches made by steps A and B may also be temporarily stored, or they may even be provided from an external pouch manufacturer.

The method in FIG. 10.*b* comprises the following steps:

E: providing two layers of flexible material in the form of sheet material which is larger than one packaging;

F: applying heat sealing resulting in a plurality of partially closed packagings according to the invention, the packagings comprising the receptacles, and the heat sealing providing a filling region by omitting a part of the sealing;

G: filling the receptacle with liquid via the filling region;

H: sealing the filling region;

I: applying cutting to form the splitter; and

J: cutting along outer circumferences of the plurality of packagings to separate them from each other.

The steps H, I, and J could be performed as one main operation step. Sealing and cutting tools are often combined and doing their individual steps nearly timewise together.

As described in more details above, the step of filling may in any of the methods be performed under aseptic conditions.

Figure 11:
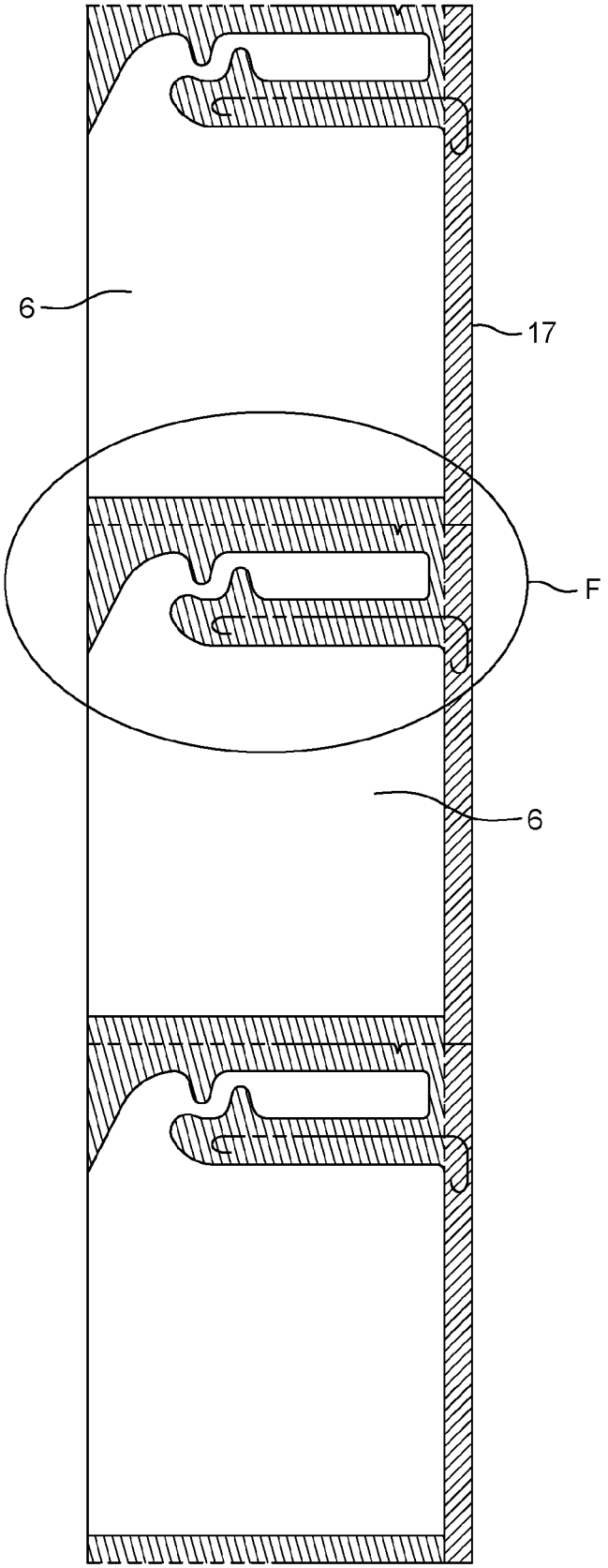
FIG. 11 schematically shows an example of a manufacturing of packagings of the type shown in FIG. 7.

FIG. 11 schematically shows an example of a manufacturing of packagings of the type shown in FIG. 7. In this example, the packagings are manufactured by a method as shown in FIG. 10.*b*. The flexible material is provided in the form of sheet material which is folded onto itself and sealed along an edge 17 extending in the longitudinal direction of the supply of material to form a tubular shape. Then a horizontal sealing is provided as shown within the circle marked F in FIG. 11. This sealing forms the receptacle 6 of the upper packaging in the figure which receptacle can then be filled. This receptacle is then closed by applying the subsequent sealing F. The steps I and J of applying cutting to form the splitter 18 and cutting along outer circumferences of the plurality of packagings to separate them from each other can be performed as two separate steps or in one combined step.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. The mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A packaging for a liquid, the packaging comprising an area of two superimposed layers of flexible material sealed together to form or close a pouch, wherein the two layers of flexible material are sealed together in a sealing region, wherein the sealing region:

extends at a distance from an edge of the packaging, and leaves a transition region free from sealing, the sealing region thereby forming a delimitation between a receptacle for holding the liquid and an outlet channel in fluid communication with the receptacle via the transition region, wherein the sealing region comprises a splitter extending along a part of the sealing region, the splitter being shaped and arranged so that it is configured to provide a spout comprising the outlet channel, wherein the spout is obtained by providing a separation extending from the edge of the packaging to the splitter, and wherein the sealing region has a shape comprising a plurality of bulges protruding in a plane of the sealing region into the outlet channel, wherein the plurality of bulges includes at least two of bulges extending into the outlet channel from a first side and at least one bulge extending into the outlet channel from a second side opposite of the first side and between the at least two bulges such that the outlet channel is self-closing.

2. The packaging according to claim 1, wherein the splitter is in the form of a first and a second spaced apart holes which are through-going and interconnected by a weakened line provided by partial cuts through the sealing region, the weakened line extending along the sealing region, the first hole being located so that applying of the separation includes applying the separation extending from the edge to the first hole and then tearing along the weakened line into the second hole.

3. The packaging according to claim 2, wherein the first hole has an elongate shape with a longitudinal extension along the sealing region.

4. The packaging according to claim 1, wherein the splitter is in the form of an elongate and through-going hole extending along the sealing region.

5. The packaging according to claim 1, wherein the splitter is in the form of a weakened line provided by partial cuts through the sealing region.

6. The packaging according to claim 1, wherein the packaging is provided with a notch extending from the edge in the direction towards the splitter.

7. The packaging according to claim 1, wherein the overall shape of the packaging is rectangular.

8. The packaging according to claim 1, comprising a sealing next to the outlet channel, said sealing comprising a slit shaped and dimensioned to receive a free end of the spout.

9. The packaging according to claim 1, wherein dimensions of the transition region and the outlet channel as well as any sealing adjacent thereto are predetermined in order to provide a stiffness of the flexible material forming the transition region and the outlet channel resulting in the self-closing outlet channel, so that, after the spout has been obtained by applying the separation, there is no flow of liquid out of the receptacle, when no pressure is applied to the packaging.

10. The packaging according to claim 1, wherein additional stiffness is provided to the packaging by a method selected from the group consisting of: embossment on one or both layers, heating of the layers, application of one or more stiffening bands, and using material with different stiffness for the two layers.

11. A method of manufacturing a packaging for a liquid, the method comprising the following steps:

arranging (A) two layers of flexible material superimposed on each other, applying heat sealing and cutting (B) resulting in the packaging, the packaging comprising an area of two layers of flexible material which layers are arranged superimposed each other and sealed together to form or close a pouch, wherein the two layers of flexible material are sealed together in a sealing region, wherein the sealing region:

extends at a distance from an edge of the packaging, and leaves a transition region free from sealing, the sealing region thereby forming a delimitation between a receptacle for holding the liquid and an outlet channel, in fluid communication with the receptacle via the transition region, wherein the sealing region comprises a splitter extending along a part of the sealing region, the splitter being shaped and arranged so that it is configured to provide a spout comprising the outlet channel, wherein the spout is obtained by providing a separation extending from the edge of the packaging to the splitter, and wherein the sealing region has a shape comprising a plurality of bulges protruding in a plane of the sealing region without facing one another while omitting a part of the sealing to provide a filling region, the plurality of bulges including at least two of bulges extending into the outlet channel from a first side and at least one bulge extending into the outlet channel from a second side opposite of the first side and between the at least two bulges such that the outlet channel is self-closing, filling (C) the receptacle with liquid via the filling region, and sealing (D) the filling region.

12. The method according to claim 11, wherein the step of filling is performed under aseptic conditions.

13. The method according to claim 11, wherein the liquid being filled in the packaging is selected from the group consisting of: fruit juice, ice tea, syrup, and drinking yoghurt.

14. A method of manufacturing a plurality of packagings for a liquid, the method comprising the following steps:

providing (E) two layers of flexible material in the form of sheet material which is larger than one packaging, applying heat sealing (F) resulting in a plurality of partially closed packagings for liquid, each packaging comprising an area of two layers of flexible material which layers are arranged superimposed each other and sealed together to form or close a pouch, wherein the two layers in each partially closed packaging are sealed together to form a respective sealing region, wherein each respective sealing region:

extends at a distance from an edge of the partially closed packaging, and leaves a transition region free from sealing, each sealing region thereby forming a delimitation between a receptacle for holding the liquid and an outlet channel in fluid communication with the receptacle via the respective transition region, wherein each sealing region comprises a splitter extending along a part of the sealing region, wherein each splitter is shaped and arranged so that it is configured to provide a spout comprising the outlet channel, and wherein each spout is obtained by providing a separation extending from the edge of the partially closed packaging to the splitter and wherein the sealing region has a shape comprising a plurality of bulges protruding in a plane of the sealing region without facing one another, the plurality of bulges includes at least two of bulges extending from the outlet channel from a first side and at least one bulge extending into the outlet channel from a second side opposite of the first side and between the at least two bulges such that the outlet channel is self-closing, the packagings comprising the receptacles, and the heat sealing providing a filling region by omitting a part of the sealing, filling (G) each receptacle with liquid via the filling region, sealing (H) the filling region, applying cutting (I) to form the splitter, and cutting (J) along outer circumferences of the plurality of packagings to separate each packaging from one another.

15. The method according to claim 14, wherein the step of filling is performed under aseptic conditions.

16. The method according to claim 14, wherein the liquid being filled in each packaging is selected from the group consisting of: fruit juice, ice tea, syrup, and drinking yoghurt.

* * * * *